United States Patent [19]

Hayamizu

[11] 4,059,934

[45] Nov. 29, 1977

[54] ARRANGEMENT FOR FASTENING AN UPSTANDING POST TO A FLOORBOARD

[75] Inventor: Seiji Hayamizu, Koshigaya, Japan

[73] Assignee: Senoh Kabushiki Kaisha, Tokyo, Japan

[21] Appl. No.: 779,233

[22] Filed: Mar. 18, 1977

[30] Foreign Application Priority Data

Sept. 3, 1976 Japan ..... 51-118448[U]

[51] Int. Cl.[2] ..... E02D 27/42

[52] U.S. Cl. ..... 52/297; 52/298; 52/704; 52/707; 52/DIG. 4

[58] Field of Search ..... 52/297, 707, 704, 708, 52/298, 711, DIG. 4; 248/337, 412; 403/370, 374, DIG. 1

[56] References Cited

U.S. PATENT DOCUMENTS

| | | | |
|---|---|---|---|
| 174,582 | 3/1876 | Shirley | 248/337 |
| 288,852 | 11/1883 | Perkins | 248/337 |
| 316,230 | 4/1885 | Brewer | 248/337 |
| 726,942 | 5/1903 | Keyes | 403/374 |
| 2,550,775 | 5/1951 | Clark | 403/DIG. 1 |
| 2,623,256 | 12/1952 | Feibelman | 403/DIG. 1 |
| 2,838,784 | 6/1958 | Cooley, Sr. et al. | 248/412 X |
| 2,842,233 | 7/1958 | Greenleaf | 403/370 |
| 2,954,638 | 10/1960 | Motter | 52/298 X |
| 3,298,653 | 1/1967 | Omholt | 52/704 X |
| 3,579,936 | 5/1971 | Andersson | 52/297 |
| 3,695,139 | 10/1972 | Howe | 52/708 X |
| 3,821,338 | 6/1974 | Faust | 52/704 X |
| 3,894,375 | 7/1975 | Lindberg, Jr. | 52/298 |
| 3,995,824 | 12/1976 | Bauer | 403/370 X |

FOREIGN PATENT DOCUMENTS

| | | | |
|---|---|---|---|
| 572,258 | 6/1924 | France | 403/374 |
| 1,058,216 | 3/1954 | France | 52/298 |

*Primary Examiner*—Leslie Braun

*Attorney, Agent, or Firm*—Haseltine, Lake & Waters

[57] ABSTRACT

An arrangement for fastening an upstanding post in a floorboard for use in indoor sports comprises a hollow cylindrical support into which the post loosely fits, having an opening provided in the circumferential wall thereof, the cylindrical support being embedded below the floorboard, a guide box which covers the opening in the cylindrical support, a headed screw rod rotatably supported in a vertical fashion in the guide box, a first wedge member screw-threadedly receiving the screw rod so that it may move upwards or downwards, a second wedge member received in the opening of the guide box so that it may move in the radial direction of the cylindrical support in accordance with the movement of the first wedge, a hole provided through the floorboard aligned in a vertical plane with the screw rod.

When a tool for turning the screw rod is inserted through the hole and rotated, the rotation of the screw rod in accordance with continuous rotation of the tool in a horizontal plane causes the first wedge member to move upwards or downwards, and thereby the second wedge member moves in the radial direction of the cylindrical member to securely fasten the post within the cylindrical support.

4 Claims, 5 Drawing Figures

ARRANGEMENT FOR FASTENING AN UPSTANDING POST TO A FLOORBOARD

The present invention relates to an arrangement for fastening an upstanding post in a floorboard for use in indoor sports, and, more particularly, to a novel arrangement which makes possible the secure fastening of an upstanding post, such as a net post for ball games or a pole for an iron bar in a floorboard in such a location as a gymnasium.

A conventional arrangement for fastening an upstanding post in a floorboard comprises a hollow cylindrical support for fitting the post therein embedded below the floorboard, a guide box provided at the outer circumferential wall of the cylindrical support, a headed screw rod, which is movable in the radial direction of the cylindrical member to fasten the post within the cylindrical support, rotatably disposed in a horizontal fashion in the guide box, a vertical hole provided through a floorboard so that it is vertically aligned with the head of the screw rod. In use, initially any suitable tool for turning the screw rod, such as a spanner or a wrench is inserted through the hole and it's driving end is fitted over the head of the screw rod. The tool is turned in such a manner that it is repeatedly swung in a vertical plane to move the screw rod in the radial direction of the cylindrical support. Thus, the post is securely tightened within the cylindrical support by the screw rod.

However, in the aforementioned conventional fastening arrangement structure, it is to be noted that it is necessary to repeatedly swing the tool in a vertical plane because of the fact that the swing movement of the tool is limited to the width of the hole provided in the floorboard. Therefore, it takes much time to fasten the post within the cylindrical support and fastening work efficiency is considerably lowered.

With the above in mind, the main object of the present invention is to provide an arrangement for fastening an upstanding post in a floorboard for use in indoor sports, the use of which arrangement makes possible the easy fastening of the support due to continuous rotation of a tool for turning the screw rod in a horizontal plane.

Another object of the present invention is to provide an arrangement for fastening a post in a floor, having a high fastening work efficiency as compared with the conventional fastening arrangement.

Still another object of the present invention is to provide an arrangement for fastening a post in a floor, which arrangement is simple in construction and the fabricating cost thereof is reduced.

A still further object of the present invention is to provide a fastening arrangement structure including a screw rod rotatably supported in a vertical fashion with respect to a floorboard, a first wedge member screw-threadedly receiving the screw rod, and a second wedge member for fastening the post within a cylindrical member in response to the action of the first wedge member.

According to the present invention, therefore, there is provided an arrangement for fastening an upstanding post in a floor for use in indoor sports comprised of a hollow cylindrical support into which the post loosely fits and having an opening provided in the circumferential wall thereof, the cylindrical support being embedded below a floorboard, a guide box provided which covers the opening in the circumferential wall of the cylindrical member, a headed screw rod rotatably supported in a vertical fashion in the guide box, a first wedge member screw-threadedly receiving the screw rod so that it may move upwards and downwards, the first wedge being prevented from rotation about the axis of the screw rod by the guide box, a second wedge member received in the opening of the guide box so that it may move in the radial direction of the cylindrical member in accordance with the movement of the first wedge member, a vertical hole provided through the floorboard in vertical alignment with the screw rod, whereby when a tool for turning the screw rod, the driving end of which is fitted over the head of the screw rod through the hole, is rotated in a horizontal plane, the first wedge member moves upwards or downwards in response to the rotation of the screw rod, and thereby the second wedge member moves in the radial direction of the cylindrical member to securely fasten the post within the cylindrical support.

The features and advantages of an arrangement for fastening an upstanding post in a floor for use in indoor sports according to the present invention will become more apparent from the following description taken in conjunction with the accompanying drawing in which.

Similar reference characters are used in the above figures to designate corresponding or similar parts.

Figure 1:
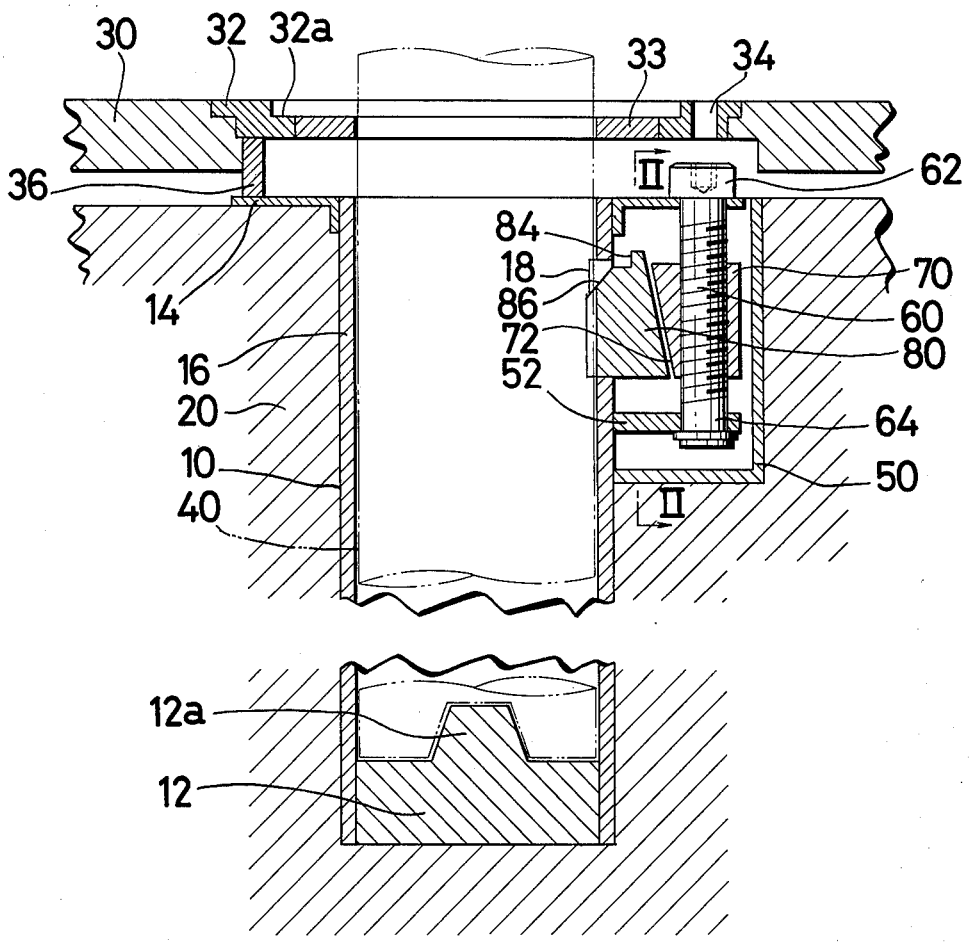
FIG. 1 is a cross sectional elevational view of an arrangement for fastening an upstanding post in a floor for use in indoor sports according to the present invention.
Figure 2:
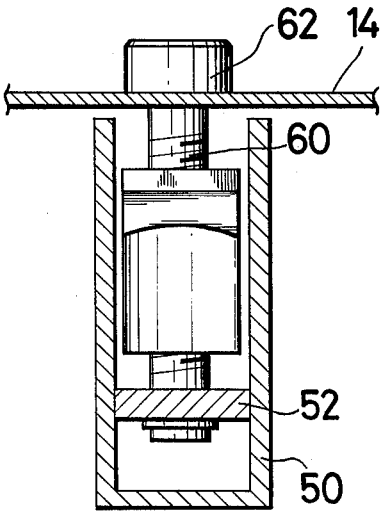
FIG. 2 is a cross sectional view taken along the line II—II in FIG. 1.

Referring to FIG. 1, the reference numeral 10 designates a hollow cylindrical support of any suitable metal, which member is embedded in a concrete block 20 below a floorboard designated by the reference numeral 30. More precisely, the cylindrical support 10 at the bottom thereof is provided with an end plate 12 having a truncated cone shaped projection **12*a* in the center thereof, and is at the upper end thereof provided with a ring-shaped flange 14. The cylindrical support 10 is further, on one side of the upper end of the circumferential wall 16, provided with an opening designated by the reference numeral 18. The reference numeral 40 designates an upstanding post shown by broken line, such as a net post for ball games or a pole for an iron bar, which post is at the lower end thereof loosely fitted into the inner circumferential wall of the cylindrical support 10**.

The reference numeral 32 designates a ring-shaped floor metal fitting fixed in the floorboard 30 by means of any suitable bolts 32', wherein a vertical hole designated by the reference numeral 34 is provided through the floor metal fitting 32 which is provided with a step portion **32*a* for receiving a removable cover plate not shown. The reference numeral 33 designates a ring-shaped metal fitting fixed in the floor metal fitting 32** for the purpose of helping to support the upstanding post 40. The reference numeral 36 designates a spacer interposed between the floor metal fitting 32 and the flange 14 provided on the cylindrical member 40.

Figure 3:
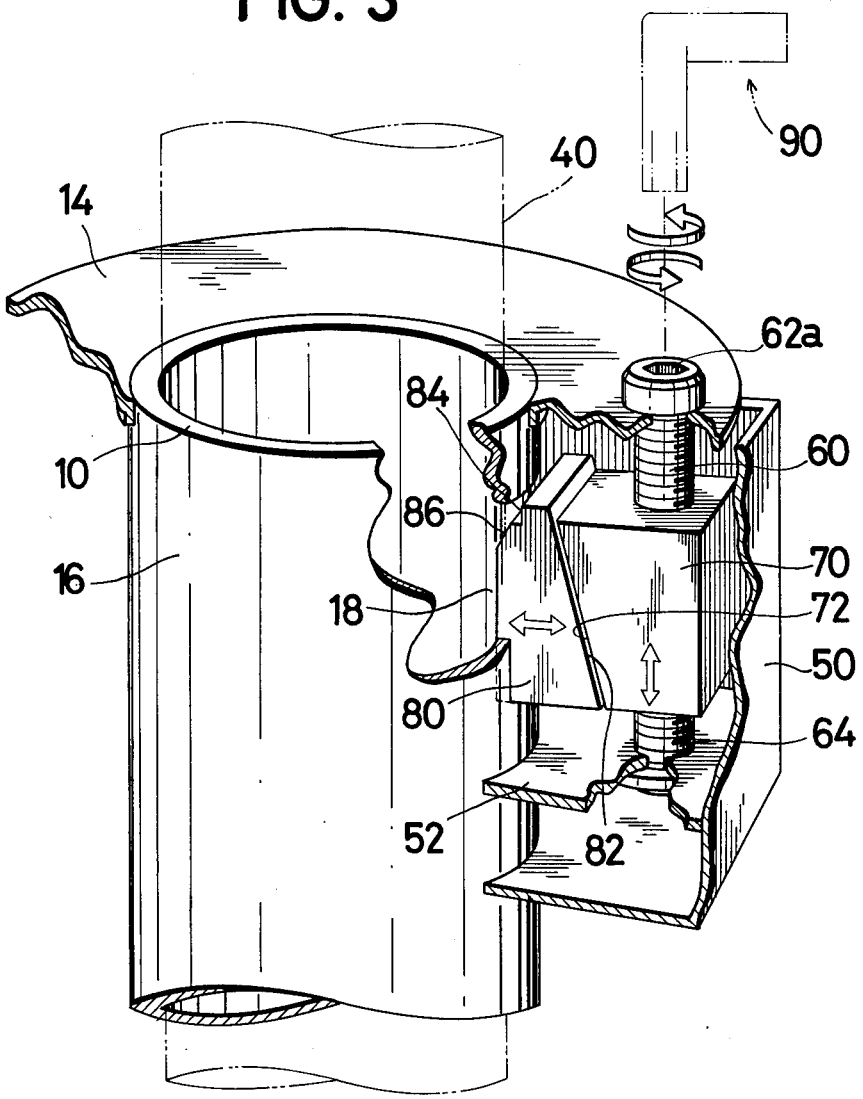
FIG. 3 is a perspective view showing the interrelation between a headed screw rod and first and second wedge members disposed in a guide box, as used in the fastening arrangement according to the present invention.
Figure 4:
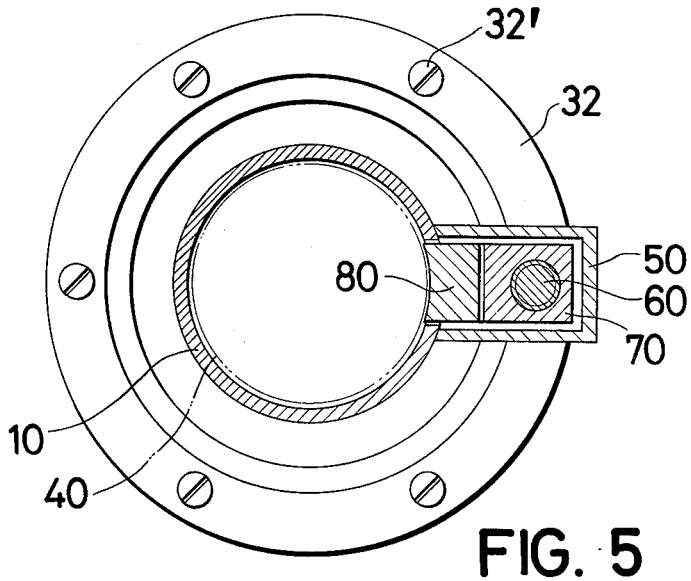
FIG. 4 is a plan view, partially in cross section of the arrangement according to the present invention.

A guide box 50 is fixed on the outer circumferential wall of the cylindrical member by means of a conventional welding method so that it covers the opening 18 provided in the cylindrical support 10. As is best shown in FIG. 3, a headed screw rod 60 is rotatably supported in a vertical fashion in the guide box 50 so that the head 62 of the screw rod 60 is disposed above the guide box 50. In more detail, the head 62 of the screw rod 60 having a hexagonal socket 62*a* is rotatably supported by the flange 14 of the cylindrical support 10 and at the lower end 64 thereof rotatably supported by a support plate 52, which is disposed within the guide box 50 which is fixed to the outer circumferential wall 16 of the cylindrical support 10.

A first wedge member designated by the reference numeral 70 screw-threadedly receives the screw rod 60 so that it may move upwards or downwards and be prevented from rotating about the axis of the screw rod 60 by the guide box 50. A second wedge member designated by the reference numeral 80 is received in the opening 18 in the cylindrical support 10 so that it may move in the radial direction of the cylindrical support 10 in accordance with the movement of the first wedge member 70. The first wedge member 70 is at the one side thereof formed with a tapered surface 72. The second wedge member 80 is at the contact side of the first wedge member 70 formed with a tapered surface 82 and is at the upper end thereof integrally formed with a step 84, the second wedge member 80 being disposed in such a manner that the step 84 is stopped against the periphery of the opening 18 in the cylindrical support 10 to prevent excessive admission when the second wedge member 80 moves in the radial direction of the support 10 to firmly fasten the post 40. The second wedge member 80 is further provided with a tapered surface 86 in the vicinity of the step 84.

Prior to referring to the role of the tapered surface 86, it is of importance to note the problem stated below. The second wedge member 80 remains positioned partially within the cylindrical support 10 after the force applied to the second wedge member 80 transmitted through the first wedge member 70 is removed and the post 40 is withdrawn from the cylindrical support 10. Thus, the portion of the second wedge member 80 partially left within the cylindrical support 10 could be an obstacle to reinserting the post in the cylindrical support 10. This is the reason why it is necessary to provide the tapered surface 86 on the second wedge member 80. That is, even if a portion of the second wedge member 80 is partially left within the cylindrical support 10, the post 40 is easily inserted sliding along the tapered surface 86 provided on the second wedge member 80.

In addition to providing the tapered surface 86 on the second wedge member 80, it is also useful to provide the second wedge member 80 with a self-return function.

In order to embody this idea, it is proposed that both wedge members 70 and 80 are made of magnetic material or one of them is made of magnetic material and the other is made of magnetizable material. With this construction, when the force applied to the second wedge member 80 through the first wedge member 70 is removed, the second wedge member 80 is outwardly attached in the radial direction of the cylindrical support 10 by the magnetic attractive force of the first wedge member 70.

Thus, the second wedge member 80 is automatically kept in a position which is not an obstacle to reinserting the post 40 into the cylindrical support 10.

Figure 5:
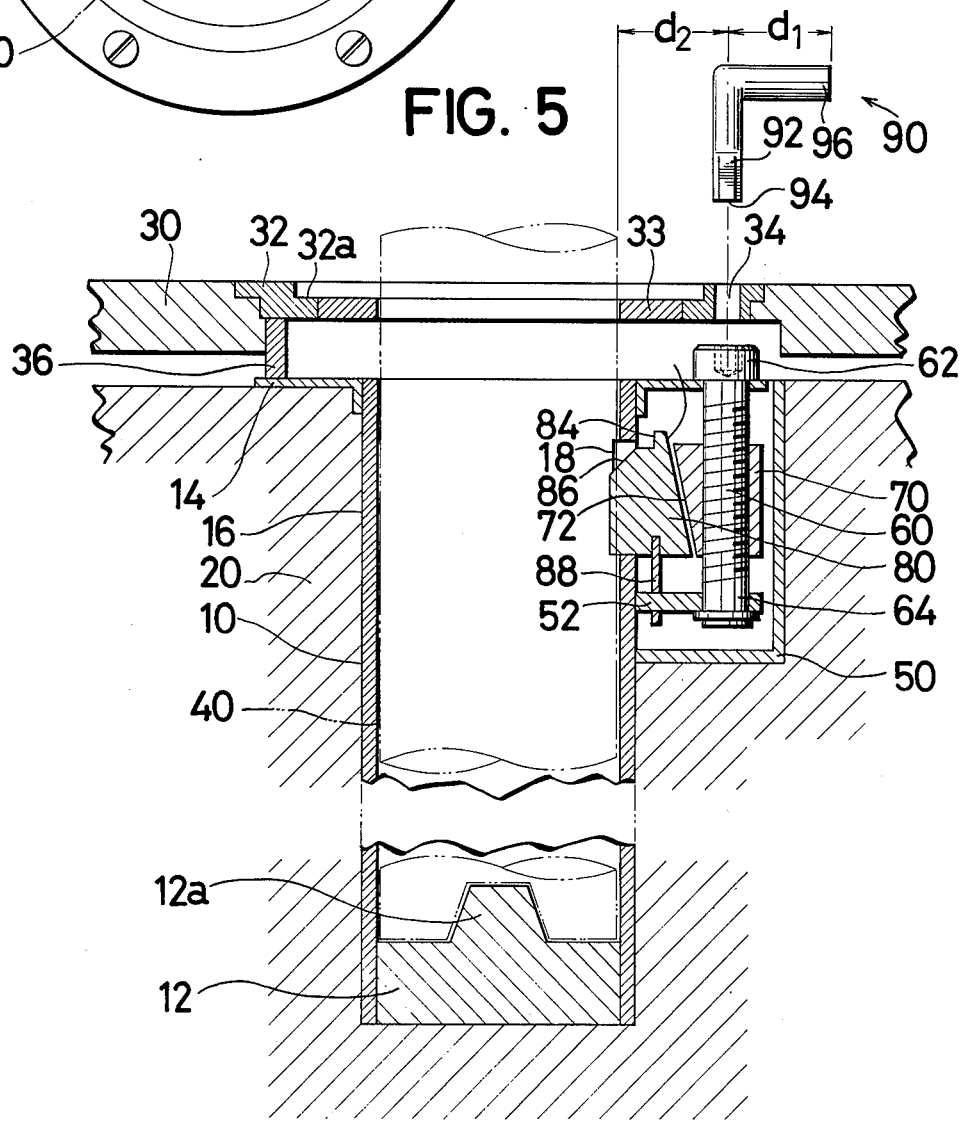
FIG. 5 is a cross sectional elevational view illustrating another modification of a wedge member return mechanism of the fastening arrangement shown in FIG. 1.

Another self-return mechanism for the second wedge member 80 is now referred to with reference to FIG. 5. This self-return mechanism consists of a flexible return leaf spring 88 provided between the lower end of the second wedge member 80 and the support plate 52.

In operation, the second wedge member 80 is positioned partially within the cylindrical support in accordance with the movement of the first wedge member 70 against the force of the return spring 88, and when the force applied to the second wedge member 80 through the first wedge member 70 is removed, the tension imparted to the return spring 88 causes the wedge member 80 to move in an outward direction radially to support 10. Thus, the second wedge member 80 is automatically returned to an initial position which is not an obstacle to reinserting the post 40 in the cylindrical support 10.

Referring now to the tool for turning the screw rod 60, as shown in FIGS. 3 and 5, in the embodiment of the present invention a conventional hexagonal key 90, which consists of a driving portion 92 having a driving end 94 thereof and a handle portion 96. It is preferable to use an hexagonal key 90 whose radius of rotation $d_1$, namely length of the handle, is less than the distance $d_2$ between the outer circumferential wall of the cylindrical support 10 and the axial line of the screw rod 60. Moreover, in case of necessity it is possible to use another type of tool as a tool for driving the screw rod, such as a spanner or a wrench.

In use, initially after the lower end portion of the post 40 is inserted into the cylindrical support 10, the driving portion 92 of the screw rod 90 is inserted through the vertical hole 34 and the driving end 94 thereof is fitted into the hexagonal socket 62*a* of the head 62 of the screw rod 60. When the handle portion 96 of the key 90 is gripped by hand and is rotated in a horizontal plane with respect to the surface of the floorboard 30, the screw rod 60 is clockwise or counterclockwise rotated about the axis thereof. Thereby, the first wedge member 70 is driven downwards without rotation due to screw-engagement between the screw rod 60 and the first wedge member 70.

The tapered surface 72 of the first wedge member 70 comes in contact with the tapered surface 82 of the second wedge member 80, and then the first wedge member 70 inwardly pushes the second wedge member 80 in the radial direction of the cylindrical support 10. Thereby, the second wedge member 80 proceeds to securely fasten the outer circumferential wall of the post 40 within the cylindrical support 10.

The second wedge member 80 continues moving inwardly in the radial direction of the cylindrical support 10 until the step 84 provided at the upper end thereof is stopped against the edge of the opening 18 provided in the cylindrical support 10. When the step 84 comes in contact with the edge of the opening 18, the rotation of the hexagonal key 90 is stopped. Thus, the upstanding post 40 is easily fastened at a predetermined pressing stress within the cylindrical support 10 by continuous rotation of the key 90 in a vertical plane. When drawing the post 40 out of the cylindrical support 10, the second wedge member 80 is withdrawn outwardly in the radial direction of the cylindrical support 10 when the pressure is removed from wedge 80 by inverse rotation of screw rod 60 in the manner stated above in accordance with the present invention.

From the foregoing description concerning the arrangement for fastening an upstanding post in a floor for use in indoor sports according to the present invention, various advantages will accrue as follows:

Since the screw rod 60 is rotatably supported in a vertical fashion in the guide box 50, it is possible to easily fasten the post 40 within the cylindrical support 10 by continuous rotation of the key 90 in a horizontal plane with respect to the surface of the floorboard 30.

Therefore, time required for fastening work can be reduced to a great extent compared with the conventional fastening arrangement characterized by the fact a screw rod is disposed in a horizontal fashion.

Since the rotational force of the screw rod 60 is transformed into the vertical movement of the first wedge member 70 which movement is transmitted to the second wedge member 80, it is easy to obtain a preferable linear movement of the second wedge member 80 which directly fastens the post 40. Therefore, it is possible to fasten the post 40 in the cylindrical support 10 at a predetermined pressure and to make fine adjustment of the fastening force.

Since the second wedge member 80 is provided with the step 84, excessive admission thereof into the cylindrical support 10 is advantageously prevented.

Since the second wedge member 80 is formed with the tapered surface 86 on the side that comes in contact with post 40, it is withdrawn to a position which is not an obstacle to reinserting the support 40 in the cylindrical support 10 after the force applied to the second wedge member 80 through the first wedge member 70 is removed. Moreover, as stated above, the provision of a self-return mechanism for the second wedge member in addition to providing the tapered surface 86 results in further improvement in smoothly reinserting the post 40 in the cylindrical support 10.

From the foregoing detailed description the reader will appreciate that the improvements over the prior art arrangement set forth earlier have been realized by the present invention and further that the specifically modified forms of the invention might be additionally modified or altered without departing from the scope of the invention which is best defined by the following claims.

What is claimed is:

1. An arrangement for fastening an upstanding post in a floor board for use in indoor sports comprising:

a. a hollow cylindrical support, being provided with an opening in the circumferential wall thereof for receiving a loosely fitted post, said support being defined by a ring-shaped flange at an upper end thereof and having a truncated conically shaped projection at the bottom thereof, said support being embedded in a concrete block positioned below the floorboard at a predetermined depth, b. a guide box, having a support plate therein, disposed on the outer circumferential wall of said cylindrical support for covering the opening in said cylindrical support, c. a headed screw rod being rotatably supported below the head thereof by said flange whereby said head appears above said guide box, and being rotatably supported at the lower end thereof by said support plate disposed within said guide box, d. a first wedge member, having a tapered surface at one side thereof, a screw for threadedly receiving said screw rod for upward and downward movement, said first wedge member being prevented from rotation about an axis of said screw rod by said guide box, e. a second wedge member, having a tapered surface facing said tapered surface of said first wedge member received in the opening of said circumferential wall of said support being movable in the radial direction of said support in accordance with movement of said first wedge member, f. step means provided at the top end of said second wedge member, said second wedge member being disposed to be stopped by the edge of said opening in said support when said second wedge member moves in a radial direction of said support to firmly press the outer circumferential surface of said post, said second wedge being further provided with a tapered surface in proximity to said step, and g. a hole provided through the floorboard being in vertical alignment with said screw rod, whereby as means for turning said screw rod at the driving end thereof are inserted through said hole said driving end being positionable in said head of said screw rod for rotation, said first wedge member being movable in an upward and downward direction in response to rotation of said screw rod, said second wedge member being in turn movable in radial direction of said support to securely fasten the outer circumferential surface of said port in said support.

2. An arrangement for fastening an upstanding post in a floorboard for use in indoor sports as defined in claim 1, wherein: both said first and said second wedge members being formed of magnetic material.

3. An arrangement as claimed in claim 1, wherein one of said wedge members is made of magnetic material and the other is made of magnetizable material for providing a self-return function.

4. An arrangement for fastening an upstanding post in a floorboard for use in indoor sports as defined in claim 1, wherein: said second wedge member is provided with a return spring for providing a self-return function.

* * * * *